United States Patent [19]

Kasugai et al.

[11] 4,188,220

[45] Feb. 12, 1980

[54] SUPPORTS FOR PHOTOGRAPHIC PAPER AND PHOTOGRAPHIC LIGHT-SENSITIVE MATERIAL

[75] Inventors: Tsuneo Kasugai; Keishi Kitagawa, both of Fujimiya, Japan

[73] Assignee: Fuji Photo Film Co., Ltd., Minami-ashigara, Japan

[21] Appl. No.: 672,357

[22] Filed: Mar. 31, 1976

[30] Foreign Application Priority Data

Mar. 31, 1975 [JP] Japan ..... 50-39526

[51] Int. Cl.[2] ..... G03C 1/85

[52] U.S. Cl. ..... 430/536; 428/513; 430/538; 525/240; 260/33.6 PQ

[58] Field of Search ..... 96/85, 87 R; 428/513

[56] References Cited

U.S. PATENT DOCUMENTS

| | | | |
|---|---|---|---|
| 3,247,290 | 4/1966 | Werkman et al. | 260/897 R |
| 3,285,742 | 11/1966 | Wagner | 96/87 R |
| 3,411,908 | 11/1968 | Crawford et al. | 96/85 |
| 3,481,812 | 12/1969 | Holob et al. | 428/513 |
| 3,501,298 | 3/1970 | Crawford | 96/85 |
| 3,884,692 | 5/1975 | Minagawa | 96/85 |

*Primary Examiner*—Jack P. Brammer

*Attorney, Agent, or Firm*—Sughrue, Rothwell, Mion, Zinn and Macpeak

[57] ABSTRACT

A support for photographic paper coated with a resin composition comprising 100 parts by weight of a polyolefin resin and about 5 to about 25 parts by weight of a low molecular weight polyolefin having a number average molecular weight of about 1,500 to about 10,000. A photographic light-sensitive material comprising such a support is also disclosed.

7 Claims, 6 Drawing Figures

SUPPORTS FOR PHOTOGRAPHIC PAPER AND PHOTOGRAPHIC LIGHT-SENSITIVE MATERIAL

BACKGROUND OF THE INVENTION

1. Field of the Invention

The present invention relates to a support for photographic paper and to a photograhic light-sensitive material. More particularly, the present invention is concerned with a waterproof support for photographic paper, on one or both sides of which a resin composition comprising a polyolefin resin and a specific amount of a low molecular weight polyolefin is coated, and which shows an improved shape of cut surfaces (cut ends) when it is cut with an edged tool, and to a photographic light-sensitive material comprising such a support.

2. Description of the Prior Art

In general, supports for photographic paper include a base paper having no coating layer, baryta paper, a water-proof support prepared by coating a polyolefin resin on both sides of a base paper, a support prepared by coating a polyolefin resin layer on a plastic film, etc. (see, for example, Japanese Patent Application No. 25881/1972 and Japanese Patent Publication No. 13327/1974).

Important properties required for supports for photographic paper include dimensional stability, moisture resistance, hiding power, the degree of whiteness, a lack of any harmful influence on a photographic emulsion layer, and, it is further required that the support be able to be cut with ease.

In the case of a support, for instance, on which a polyolefin having a molecular weight of about 12,000 to about 500,000, preferably 20,000 to 200,000, is coated, when the support is cut with a guillotine cutter, for example, the polyolefin layer is stretched from the surface of the support by the upper and lower blades of the cutter due to the shearing force thereof, thereby deteriorating the cut surface, and thus the value of product is markedly reduced.

SUMMARY OF THE INVENTION

It has been desired to remove the above described defect of a support for photographic paper on which a polyolefin resin is coated.

It has now been found that the above defect is eliminated by incorporating a specific amount of a low molecular weight polyolefin into a conventional polyolefin resin layer.

The present invention thus provides a support for photographic paper coated with a resin composition comprising 100 parts by weight of a polyolefin resin and about 5 to about 25 parts by weight of a low molecular weight polyolefin having a number average molecular weight of about 1,500 to about 10,000.

DETAILED DESCRIPTION OF THE INVENTION

The present invention is characterized in that a specific amount of a low molecular weight polyolefin is incorporated into a conventional polyolefin resin used for a coating layer of a support for photographic paper.

The resulting polyolefin resin composition may be coated on any base support, with typical base supports including paper, plastic or mixtures thereof, for example, a film or sheet of a thermoplastic resin which may optionally contain dyes or pigments, a paper comprising natural wood pulp and/or a synthetic resin pulp, most preferably, a paper which comprises natural pulp and/or a synthetic thermoplastic pulp. Although various kinds of layer constructions can be used, fundamental layer constructions are shown in FIGS. 1 and 2.

Figure 1:
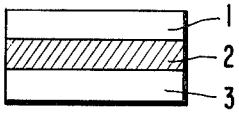
FIGS. 1 and 2 are sectional views showing the layer constructions of supports for photographic paper.

In FIG. 1, layers 1 and 3 may both be clear polyolefin layers, layer 1 may be a polyolefin layer containing a white pigment such as titanium dioxide or the like, and layer 3 may be a clear polyolefin layer, or layers 1 and 3 may both be polyolefin layers containing a white pigment. In any case, layers 1 and 3 can, if desired, contain conventional additives such as an antistatic agent, an antioxidant, a stabilizer, and the like. The amounts and kinds of these additives can be determined by referring to Japanese Patent Application No. 25881/1972, Japanese Patent Publication 13327/1974, etc.

Figure 2:
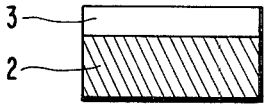

In FIG. 2, layer 3 may be either a clear polyolefin layer or a polylolefin layer containing a white pigment.

Layer 2 in FIG. 1 and layer 2 in FIG. 2 are both base supports, and for this base support there can be used polystyrene, polyesters such as polyethylene terephthalate, polybutylene terephthalate, etc., synthetic papers such as bi- or uniaxially oriented polystyrene, polyolefins, polyvinyl chloride, natural pulp papers, and the like. The thickness of the base support is generally about 30 to about 500 microns, though such is not limitative.

The surface of the polyolefin resin layer containing a white pigment is generally subjected to a surface activation treatment, undercoating treatment, etc., if necessary, and then a photographic emulsion layer is coated thereon to prepare a sheet of photographic paper.

Surface activation treatments are described in British Pat. Nos. 715,914, 771,234, 879,224, 989,377, 971,058, 1,005,631, 1,060,526, 1,010,649, 1,019,664, 1,043,703, 1,076,410, 1,134,211, 1,136,902, and 1,294,116, U.S. Pat. Nos. 2,715,075, 2,846,727, 3,072,483, 3,076,720, 3,153,683, 3,225,034, 3,375,126, 3,411,908, 3,431,135, 3,520,242, 3,549,406, and 3,590,107, etc. The techniques described in these patents can be used in the present invention.

Photographic emulsion layers are provided by coating conventional silver halide photographic emulsions, color photographic emulsions, diazo photographic emulsions, and the like, in which natural polymer compounds such as gelatin, derivatives thereof, and the like, synthetic polymer compounds such as polyvinyl alcohol, polyvinyl pyrrolidone, and the like, etc., are used as binders. Such emulsions are described in detail in the above patents. All such emulsion can be used in the present invention.

The photographic paper thus prepared is image-wise exposed and developed in a conventional manner, and the resulting completed photographic paper is cut to a predetermined size with a guillotine cutter or the like. In general, of course, photographic papers are cut during manufacturing processing and after development; while, of course, the present applies to both types of cutting, it offers particularly beneficial effects with respect to the latter type of cutting.

Although the ingredients for use in the light-sensitive layer of the present invention, development, fixing, drying, etc., are generally described above, they are further described in detail in the following literature: Kikuchi, Shashin Kagaku (Photograhic Chemistry), Kyoritsu Shuppan (1973), C. E. K. Mees, *The Theory of The Photographic Process*, 3rd Ed., etc. Further, other techniques well known in the art can be used.

The ingredients for the resin layer of the present invention will now be described in detail.

In the present invention, as described above, about 5 to about 25 parts by weight of a low molecular weight polyolefin having a number average molecular weight of about 1,500 to about 10,000 is added to 100 parts by weight of a polyolefin conventionally used for lamination, and the resulting resin composition is coated on the base layer. When the amount of the low molecular weight polyolefin to be added is below about 5 parts by weight, the effect of improving cut surfaces is small, whereas if the low molecular weight polyolefin is added in an amount exceeding about 25 parts by weight, although the effect of improving the cut surfaces is large, problems take place in that neck-in, surging, etc., increase during coating the resin composition by extruding it onto the base layer with an extruder at high temperatures, thereby deteriorating extrusion capability and ease of production.

In the case of the polyolefin layer on which the emulsion layer is coated, since the rather brittle emulsion layer prevents the polyolefin layer from being stretched when the support is cut with a cutter, the cut surface is of good quality and causes no great problem. However, in the case of the polyolefin layer on which no emulsion layer is coated, the polyolefin layer is stretched when the support is cut with a cutter, and, thus, in this case, the effect of the present invention is remarkable.

The term "polyolefin" as is applied to both the "polyolefin resin" and the low molecular weight "polyolefin" as is used herein includes poly-$\alpha$-olefins such as an $\alpha$-olefin having 2 to 5 carbon atoms, e.g., polyethylene, polypropylene, etc.; copolymers containing at least 50 mol% of such an $\alpha$-olefin, especially ethylene and/or propylene as main a component(s), and vinyl acetate, acrylic acid, an acrylate (e.g., ethyl acrylate, etc.), a methacrylate, etc.; and mixtures thereof. That is, in accordance with the present invention, the low molecular weight polyolefin can differ only in molecular weight from the conventional polyolefin resin or can differ in composition per se. The conventional polyolefin resin preferably has a molecular weight ranging from about 20,000 to about 200,000, a density of about 0.90 to about 0.97 and melting point of 100° to 170° C., and can be subjected to extrusion coating.

In the present invention, although the polyolefin layer is not limited in thickness, the thickness is generally from about 10 to about 100 microns, and, in particular, a thickness ranging from 15 to 50 microns is most suitable for photographic paper.

Needless to say, mixtures of conventional polyolefin resins can be used with a single low molecular weight polyolefin or in combination with mixtures of low molecular weight polyolefin resins, or vice versa, in accordance with the present invention, if desired.

Of course, various modifications such as the provision of the polyolefin resin layer in a multi-layer construction, changes in the amount of the pigment to be added, changes in the amount of other additives added, typically blueing agents, optical brighteners, antistatic agents and the like as are conventional in the art, changes in the kind of the polyolefin used, etc., can be made as necessary. Typical, pigments will be added, when used, in an amount of from about 5 weight % to about 30 weight %, based on the total weight of the polyolefin layer(s).

The term "low molecular weight polyolefin" as used herein designates those polymers having a number average molecular weight of about 1,500 to about 10,000 and a density of not less than about 0.89 (when measured by JISK 6760-1966). While not limitative, it is most preferred that the low molecular weight polyolefins used have a density no greater than about 0.97 (when measured by JISK 6760-1966).

The molecular weight of the conventional polyolefin resin can be determined by gel permeation chromatograpy, membrane, osmometry, vapor pressure, intrinsic viscometry, light scattering, ultracentrifugation, sedimentation, etc. In this application, unless otherwise indicated, molecular weights for the conventional polyolefin resin are also expressed as number average molecular weights. In both the case of the conventional polyolefin resin and the low molecular weight polyolefin, number average molecular weights were determined by membrane osmometry. It is most preferred in accordance with the present invention that the higher molecular weight polyolefin resin exhibit a number average molecular weight which is at least about 2,000 higher than that of the low molecular weight polyolefin resin, with greater molecular weight differences being even more preferred.

The polyolefin resin and the low molecular weight polyolefin can be blended by any known method. For instance, the resins can be melted and mixed by an extruder, a heat mixing roll, a Banbury mixer, a kneader, etc., and crushed or pelletized, or the resins can be supplied directly to an extruder in the form of a simple blend in effecting extrusion coating, or the low molecular weight polyolefin can be adhered to the surface of the polyolefin resin by a Henschel mixer, etc., and then supplied directly to an extruder, etc. Typically, the polyolefin resin and the low molecular weight polyolefin are applied by extruding at a temperature on the order of about 250 to about 330° C., though this range is not, of course, limitative.

Numerous modifications of resins by polymer blending have been made for various purposes.

For instance, Japanese Patent Publication No. 22187/1964 describes that the blending of polypropylene and polyethylene improves the impact resistance and low temperature properties of polypropylene.

Japanese Patent Publication No. 11025/1969 describes a method of producing a polypropylene film having a low friction coefficient by blending polypropylene and 0.05 to 3% of polyethylene, and Japanese Patent Publications Nos. 12786/1961 and 12787/1961 describes that the light resistance of polypropylene can be improved by adding polyethylene thereto.

Moreover, it is known that the incorporation of polyethylene wax into polypropylene improves the transparency and heat sealing properties of the polypropylene film.

However, no one has ever suggested improving the cut surface of a support for water-proof photographic paper (the base support of which is coated with a polyolefin resin) upon cutting by incorporating a low molecular weight polyolefin into a conventional polyolefin resin layer.

Although the addition of natural wax, paraffin wax, microcrystalline wax, etc., to poly α-olefins is well known in the field of films and wrapping materials, in a support for photographic paper coated with a polyolefin resin into which wax, etc., having a low melting point of the order of 50° C., is added, the wax, etc., exudes to the surface thereof with the passage of time or upon the application of heat during drying, thereby adversely affecting the photographic properties, making a ferrotype dirty during ferrotyping after development, and reducing the heat resistance thereof.

The present invention will now be explained in more detail by reference to the following examples, although the present invention is not intended to be limited thereto.

Figure 3:
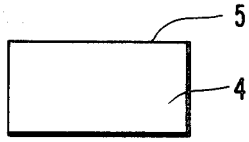
FIGS. 3 through 6 are plan views of supports for photographic paper.
Figure 4:
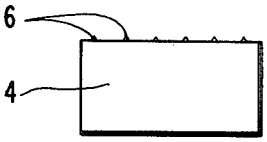
Figure 5:
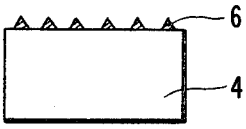
Figure 6:
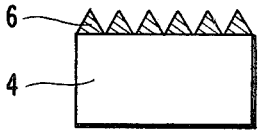

The quality of a cut surface was evaluated as follows: the support was cut with a cutter and classified as A, B, C, or D depending on the extent that the polyolefin film was stretched. FIGS. 3 to 6 show enlarged plan views of supports after cutting. A designates a support as shown in FIG. 3 where the support is cut without stretching the polyolefin layer and the cut surface is sharp; B designates a support as shown in FIG. 4 in which the polyolefin layer is slightly stretched and such can be visually detected; C designates a support as shown in FIG. 5 in which the polyolefin is stretched over almost all the cut surface and such can be visually detected; and D designates a support as shown in FIG. 6 in which the polyolefin is highly stretched all over the cut surface. In these figures, 4 is the support provided with the polyolefin layer, 5 is the cut surface, and 6 is the stretched polyolefin.

A and B are grades acceptable to the art for photographic use.

The results of the following examples establish that the quality of a cut surface is markedly improved by coating a resin composition containing more than about 5% by weight, preferably more than 15% by weight, of one or more low molecular weight polyolefins, based on the weight of the total polyolefins utilized therein.

EXAMPLE 1

On one side of high quality paper having a basis weight of 150 g/m$^2$ was coated a resin composition prepared by adding a low molecular weight polyethylene (having a number average molecular weight of 5,000, a density of 0.93, and a softening point of 111° C.) in an amount as shown in Table 1 to 100 parts by weight of polyethylene (having a molecular weight of 30,000 and a density of 0.945) at 300° C. by extrusion coating to a thickness of 0.04 mm.

The support with the polyethylene coated on one side thereof was cut with a guillotine cutter, and the cut surface evaluated by the method described above. The results are shown in Table 1.

Table 1

| Amount of Low Molecular Weight Polyethylene (parts by weight) | Evaluation |
|---|---|
| 0 | D |
| 5 | B |
| 10 | A |
| 15 | A |
| 20 | A |
| 25 | A |

EXAMPLE 2

On one side of high quality paper having a basis weight of 100 g/m$^2$ was coated a resin composition prepared by adding 0 to 20 parts by weight of a low molecular weight polyethylene (having a number average molecular weight of 2,000, a density of 0.930, and a softening point of 107° C.) to 100 parts by weight of polyethylene (having a molecular weight of 100,000 and a density of 0.950), at 300° C. by extrusion coating to a thickness of 0.035 mm and the other side was coated with a composition prepared by adding 5 parts by weight of titanium dioxide to the above resin composition to a thickness of 0.035 mm. On the polyethylene layer containing titanium dioxide there was provided a common color photograhic emulsion layer having the composition set forth below to a thickness of 12 microns to produce a sheet of photographic paper.

Color Photographic Emulsion Layer (coated thereon in the following order)

(1) a blue sensitive gelatino silver chlorobromide emulsion containing (4-benzoylacetamido-3-methoxy-(2',4'-di-tert-amylphenoxy)-acetanilide;)

(2) a gelatin interlayer;

(3) a green sensitive gelatino silver chlorobromide emulsion containing 1-(2',5'-dichlorophenyl)-3-[3''-(2''',4'''-di-tert-amyl-phenoxyacetamido)benzamido]-5-pyrazolone;

(4) a gelatin interlayer;

(5) a red sensitive gelatino silver chlorobromide emulsion containing 6-{{α-{4-[α-(2,4-di-tert-amylphenoxy)butyramido]phenoxy}-acetamido}}2,4-dichloro-3-methylphenol;

(6) a gelatin protective overcoat.

The thus obtained photographic paper was cut with a punch type cutter, and the cut surface was evaluated. The relationship between the cut surface and the amount of the low molecular weight polyethylene is shown in Table 2.

Table 2

| Amount of Low Molecular Weight Polyethylene (parts by weight) | Evaluation |
|---|---|
| 0 | D |
| 7 | B |
| 15 | A |
| 20 | A |

EXAMPLE 3

On one side of a monoaxially stretched polystyrene base having a thickness of 100 microns which had been subjected to a conventional corona discharge surface treatment there was coated a resin composition prepared by adding a low molecular weight polypropylene (having a number average molecular weight of 3,000, a density of 0.89, and a softening point of 145° C.) in the amount shown in Table 3 to 100 parts by weight of polypropylene (having a molecular weight of 80,000 and a density of 0.90) at 300° C. by extrusion coating to a thickness of 0.030 mm.

The thus obtained support was cut with a conventional cutter for photography, and the cut surface evaluated. The relationship between the amount of the low molecular weight polypropylene and the cut surface is shown in Table 4.

Table 4

| Amount of Low Molecular Weight Polypropylene (parts by weight) | Evaluation |
|---|---|
| 0 | D |
| 3 | C |
| 10 | B |
| 15 | A |

While the invention has been described in detail and with reference to specific embodiments thereof, it will be apparent to one skilled in the art that various changes and modifications can be made therein without departing from the spirit and scope thereof.

What is claimed is:

1. A base support coated with a resin composition which comprises about 5 to about 25 parts by weight of a low molecular weight polyolefin having a number average molecular weight of from about 1,500 to about 10,000 in combination with 100 parts by weight of a polyolefin resin having a number average molecular weight of 20,000 to 200,000.

2. The support of claim 1, wherein any polyolefin is selected from the group consisting of polyethylene, polypropylene, copolymers containing ethylene and propylene as main components, and mixtures thereof.

3. The support of claim 1, wherein the base support is selected from the group consisting of paper, barytacoated paper, a plastic sheet, and a synthetic resin paper.

4. A photographic light-sensitive material comprising a base support coated with a resin composition which comprises from about 5 to about 25 parts by weight of a low molecular weight polyolefin having a number average molecular weight of about 1500 to about 10,000 in combination with 100 parts by weight of a polyolefin resin having a number average weight of 20,000 to 200,000 and with a photographic light-sensitive layer.

5. The photographic light-sensitive material of claim 4, wherein said photographic light-sensitive layer comprises a gelatino-silver halide photograhic emulsion.

6. In a method for preventing the stretching of a polyolefin layer coated on a base support and having overcoated on said polyolefin layer a light-sensitive layer, the improvement which comprises incorporating from about 5 to about 25 parts by weight of a low molecular weight polyolefin having a number average molecular weight of about 1500 to about 10,000 into 100 parts by weight of a polyolefin resin having a number average molecular weight of 20,000 to 200,000.

7. The method of claim 6, wherein said light-sensitive layer is a photographic gelatino-silver halide light-sensitive layer.

* * * * *